US005148651A

United States Patent [19]

Masuda et al.

[11] Patent Number: 5,148,651

[45] Date of Patent: Sep. 22, 1992

[54] UNWRAPPING APPARATUS WITH SWING ARMS AND GRIPPERS

[75] Inventors: Tadao Masuda; Masahiro Tsukuda; Shigeru Doiura; Kaoru Kawanishi, all of Takatsuki; Hiroshi Iwasaki, Tokyo, all of Japan

[73] Assignee: Oji Seitai Kaisha, Ltd., Tokyo, Japan

[21] Appl. No.: 771,629

[22] Filed: Oct. 3, 1991

[30] Foreign Application Priority Data

Jan. 30, 1991 [JP] Japan ..... 3-27726

[51] Int. Cl.[5] ..... B65B 43/26

[52] U.S. Cl. ..... 53/381.2; 53/381.1; 53/492

[58] Field of Search ..... 414/412; 53/381.1, 381.2, 53/384.1, 492

[56] References Cited

U.S. PATENT DOCUMENTS 4,050,223 9/1977 Steeg et al. ..... 53/381.2

FOREIGN PATENT DOCUMENTS 48-58995 8/1973 Japan .
49-95788 9/1974 Japan .
1-111642 4/1989 Japan .
2-166033 6/1990 Japan .

*Primary Examiner*—John Sipos
*Assistant Examiner*—Linda B. Johnson
*Attorney, Agent, or Firm*—Burns, Doane, Swecker & Mathis

[57] ABSTRACT

An unwrapping apparatus for unwrapping a palletized and stretch-wrapped load, the apparatus enables the prevention of the articles from falling off and easy disposal of the used stretchable film. The apparatus comprises first and second upright frames between which a load to be unwrapped is conveyed, the first upright frame including two lower grippers for gripping a lower edge of the stretchable film, and an elevated cutter unit having two pairs of pinch rollers and a heat cutter. The second upright frame includes a carriage having a platen to press the top of the load to be unwrapped and a pair of swing arms symmetrically arranged on either side of the platen and extending toward the first upright frame. Upper grippers are secured to the swing arms, respectively. The stretchable film can be gripped during the cutting and unwrapping of the load to maintain tension and prevent the articles in the load from falling off. In addition, the used stretchable film can be discharged in a compressed, compact form.

9 Claims, 10 Drawing Sheets

UNWRAPPING APPARATUS WITH SWING ARMS AND GRIPPERS

BACKGROUND OF THE INVENTION

1. Field of the Invention

The present invention relates to an unwrapping apparatus for unwrapping a stretch-wrapped load comprised of a pallet, a plurality of articles palletized on the pallet and a stretchable film wrapping the articles and the pallet together, and in particular, the present invention relates to an unwrapping apparatus for unwrapping a stretch-wrapped load by cutting a stretchable film of the stretch-wrapped load and removing it so as not to allow the film of any shrinkage until it (or the film) completely separates from the palletized articles.

2. Description of the Related Art

In transportation, one known form of load is a "pallet-wrapping" or "unitizing", in which articles are placed on a pallet and the articles are bound together with the pallet by means of, for example, a strapping, a shrink wrapping or a stretch wrapping. The stretch wrapping involves the use of a stretchable or elastic plastic film that is automatically wound around the articles and the pallet under tension to unitize the articles and the pallet together. A so-called "pallet stretch wrapping" can be performed with less labor and has become one of the most popular pallet-wrapping techniques. In an example of such palletized and stretch-wrapped load, glass bottles, PET (polyethylene terephthalate) bottles, or metallic cans are placed on a pallet via separate sheets or tier sheets and they are stretch-wrapped together with a stretchable film. Such a palletized and stretch-wrapped load may be transported to a user.

Proposals have been made on an apparatus and a method for stretch wrapping and disclosed in, for example, Japanese Examined Patent Publication (Kokoku) No. 58-7524, No. 59-9403, No. 59-40682, No. 59-46845, No. 59-52087, and No. 61-27254.

In this manner, automated systems have been developed regarding the stretch wrapping. However, unwrapping the stretch-wrapped load has not yet been fully developed and in many cases, unwrapping is carried out manually by cutting the stretchable film encircling the load by a hand cutter, removing the stretchable film from the load, and crumpling it to discard same.

Proposals have been made for an automatic unwrapping apparatus and disclosed in, for example, Japanese Unexamined Patent Publication (Kokai) No. 48-58995, No. 49-95788, No. 1-111642, and No. 2-166033. These machines automatically remove the stretchable film from the stretch-wrapped load, but they must have a complex structure and working steps to completely remove the stretchable film from the palletized and stretch-wrapped load.

For example, in Japanese Unexamined Patent Publication (Kokai) No. 48-58995, the unwrapping apparatus includes four movable grippers 5 arranged at four corners of the palletized and stretch-wrapped load to be unwrapped, a pair of cutters 7 arranged at opposite side surfaces of the load, floating rollers 8 arranged at the remaining opposite side surfaces of the load to cooperate with the grippers 5, a further top cutter 11, and a retractable support 12 for the floating rollers 8. The unwrapping apparatus further includes supporting and actuating arrangements to move these elements in many directions.

In Japanese Unexamined Patent Publication (Kokai) No. 49-95788, the unwrapping apparatus includes a conveyor 4 having an elevator 6, cutter unit 19 having vertical chains 16 and cutters 17 attached to the chains 16 to cut the opposite side of the cover (of stretchable or shrinkable film) 3, winding rollers 30 arranged at four corners of the elevator 6 for nipping the cut cover 3, suction heads 31 arranged at four sides of the elevator 6 for supporting the four sides of the cover 3, a top cutter 34, and a top trolley 44 with top suction heads 46. The top of the cover 3 is cut first and then the remaining portion is cut into four side pieces. Each of these four side pieces is held at its lower portion by the suction head 31 and the upper portion of the cut side piece falls and is nipped by the winding rollers 30.

In Japanese Unexamined Patent Publication (Kokai) No. 1-111642, the unwrapping apparatus includes a pre-cutting device arranged at the station A and comprising bottom corner cutter units 13 to cut the cover of stretchable or shrinkable film bottom corners of the palletized load along cutting lines 18 (FIG. 3), suction heads 19 to cooperate with the bottom corner cutter units 13, side cutter units 14 to cut slits 21 (FIG. 1). The unwrapping apparatus also includes, at the station B, a lifter conveyor 26, suction heads 27, heat cutters 40 adjacent the suction heads 27, lateral spreading units 33 having fingers 36, and elevated frames 38 having main cutter units 41 with hot air nozzles 44. The main unwrapping sequences are shown in FIGS. 7 to 10.

In Japanese Unexamined Patent Publication (Kokai) No. 2-166033, the unwrapping apparatus includes a cutter unit C with a hot air cutter 25, a holding unit H having a suction head 33, and a removing unit R having a pair of pinch rollers 41 and 42. The holding unit H can hold the film 2 while the cutter unit C cuts the film 2. The holding unit H can also act to guide the cut sheet 2 to the removing unit R.

In the stretch wrapping, the stretchable film in tension unitizes the articles and the pallet together and maintains contact with the articles located at the peripheral regions of the stretch-wrapped load. The stretched film may enter any gaps or cavities between the peripheral edges of the separate sheets or between the peripheral edges of the separate sheet and the pallet, especially at the corners of the stretch-wrapped load due to the unitizing force of the stretched film, so the film contacts the articles in the stretch-wrapped load. When the stretch-wrapped load is to be unwrapped, the stretchable film is cut, causing the stretchable film to suddenly shrink due to an immediate release from the tension applied to it. This sudden (or rapid) shrinkage of the stretchable film is liable to cause the stretchable film to move or shift the palletized articles in contact with said film on the separate sheet, and if the articles are empty and light, they may fall down out of the separate sheet, in particular from the uppermost separate sheet. Also, a similar problem arises when the already cut stretchable film is separated (or removed) from the palletized articles.

The unwrapping apparatuses described in the above Patent Publications do not have appropriate means to solve this problem and are not adapted for unwrapping the stretch-wrapped load in which empty and light articles, such as bottles are placed in bulk therein.

Also, the stretchable film must be disposed (to waste) after it is cut and removed from the palletized articles.

But the unwrapping apparatuses described in the above Patent Publications do not have appropriate means to easily dispose the used and bulky stretchable film (to waste).

SUMMARY OF THE INVENTION

The object of the present invention is to solve the above described problems and to provide an unwrapping apparatus for unwrapping a stretch-wrapped load comprised of a pallet, a plurality of articles, such as empty and light bottles stacked in bulk, via a separate sheet placed on (or under) each layer of the palletized articles, and a stretchable film wrapping the articles and the pallet together, by which the unwrapping can be reliably effected without articles falling down from the separate sheets.

The another object of the present invention is to provide an unwrapping apparatus by which the stretchable film can be easily disposed by compressing it into a compact form after it is cut and removed from the palletized articles.

According to the present invention, there is provided an unwrapping apparatus for unwrapping a stretch-wrapped load comprised of a pallet, a plurality of articles palletized on the pallet and a stretchable film wrapping the articles and the pallet together, said unwrapping apparatus comprising: first and second upright frames arranged in a spaced relationship; means for conveying a load to be unwrapped to a position between the first and second upright frames; two lower gripper means arranged on the first upright frame for gripping a lower edge of the stretchable film of the load to be unwrapped, each of the lower gripper means being movable toward and away from the load to be unwrapped; a cutter unit arranged on the first upright frame between the two lower gripper means for upward and downward movement along the first upright frame, the cutter unit having two pairs of pinch rollers with one of each pair of pinch rollers positioned on the exterior side of the stretchable film and the other on the interior side of the stretchable film to grip the stretchable film therebetween, and cutting means adapted to cut the stretchable film; and a carriage arranged on the second upright frame for upward and downward movement along the second upright frame; the carriage having pressing means to press a top central region of the load to be unwrapped to stabilize the latter while being unwrapped, and a pair of swing arms symmetrically arranged on either side of the pressing means and extending toward the first upright frame; each of the swing arms having one end pivotally attached to the carriage, and the other end provided with an upper gripper means for gripping an upper edge of the stretchable film of the load to be unwrapped, each of the upper gripper means being movable upwards and downwards toward and away from the load to be unwrapped, whereby the stretchable film which is cut by the cutting means, is spread and separated from the load in accordance with a swing motion of the swing arms.

With this arrangement, the pressing means is first actuated to press the top central region of the stretch-wrapped load to be unwrapped to stabilize it. Then the lower gripper means is actuated to grip the lower edge of the stretchable film of the stretch-wrapped load to be unwrapped, and the cutter unit is actuated to cut the stretchable film from the lower edge to the upper edge of the stretchable film. The cutter unit is momentarily stopped at a position near the upper edge of the stretchable film and moves upwards again to cut the remaining upper portion of the stretchable film after the upper gripper means grips the upper edge of the stretchable film.

In this way, according to the present invention, the stretchable film is gripped by the lower grippers or both of the lower and upper gripper means during a term from the start of the cutting to the end of the cutting, to thereby prevent the stretched wrapping sheet from shrinking during the cutting.

When the stretchable film is fully cut, the upper gripper means is moved upwardly and the lower gripper means is actuated to release the lower edge of the stretchable film. Then the swing arms carrying the upper gripper means are actuated to swing about the respective pivot ends to spread the severed stretchable film toward the either side from the cutting line. The swing motion of the swing arms are accompanied by the forward extension of the upper gripper means, to thereby prevent the stretched wrapping sheet from shrinking during the opening motion of the upper gripper means to remove the stretchable film from the palletized articles.

In this way, according to the present invention, the stretchable film is prevented from shrinking while the stretchable film is separating from the palletized articles, and thus it is possible to prevent the articles from falling off the separate sheet.

Preferably, the cutting means comprises an electric heat cutter (or a hot wire cutter). But the cutting means may be of the type having a knife edge.

Preferably, the stretchable film including the multiple layers of the film encircling the articles, and the carriage further includes a heatsealer means for upward and downward movement toward and away from the load to be unwrapped to heatseal and join together the plurality of layers of the stretchable film wound around the palletized articles.

Preferably, the carriage further includes a ring-like collecting guide for collectively guiding the stretchable film that is cut and separated from the load, a pusher pushing the stretchable film into the collecting guide, and a pair of discharge nip rollers arranged on the outlet side of the collecting guide to continuously compress and discharge the stretchable film pushed into the collecting guide.

The stretchable film that is gripped at its upper edge by the swinging upper gripper means, and thus separated from the palletized articles, is collectively pushed into the collecting guide by the pusher, and then compressed by the discharge nip rollers into a compact shape. The stretchable film is thus discharged in a compact shape. Therefore, it is easy to dispose the used stretchable film to waste.

BRIEF DESCRIPTION OF THE DRAWINGS

The present invention will now be described in greater detail in accordance with the following description of the non-limitable preferred embodiment, with reference to the accompanying drawings, in which.

DESCRIPTION OF THE PREFERRED EMBODIMENTS

Figure 1:
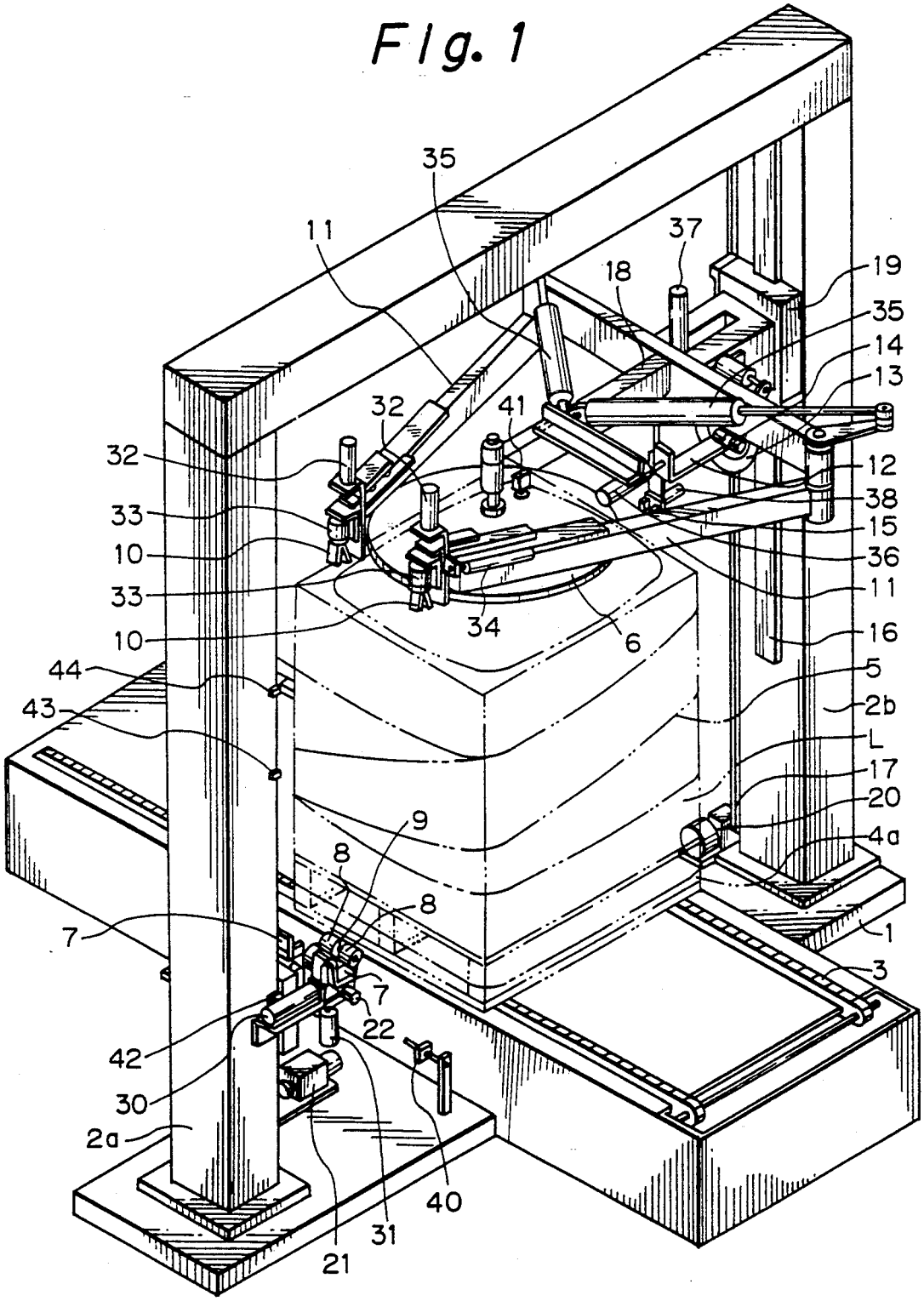
FIG. 1 is a perspective view of an unwrapping apparatus according to the embodiment of the present invention.
Figure 2:
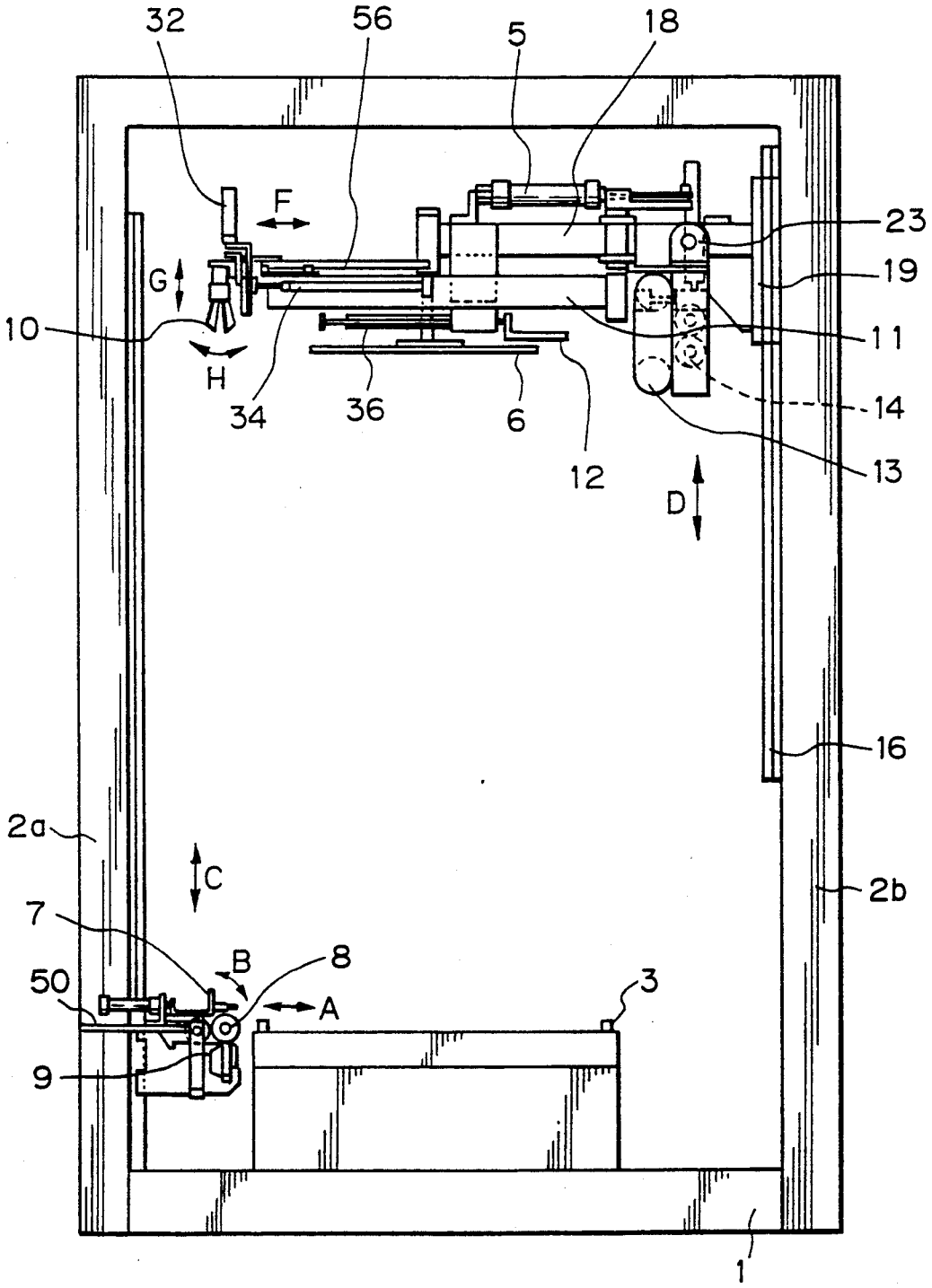
FIG. 2 is an elevational side view of the unwrapping apparatus of FIG. 1.
Figure 10:
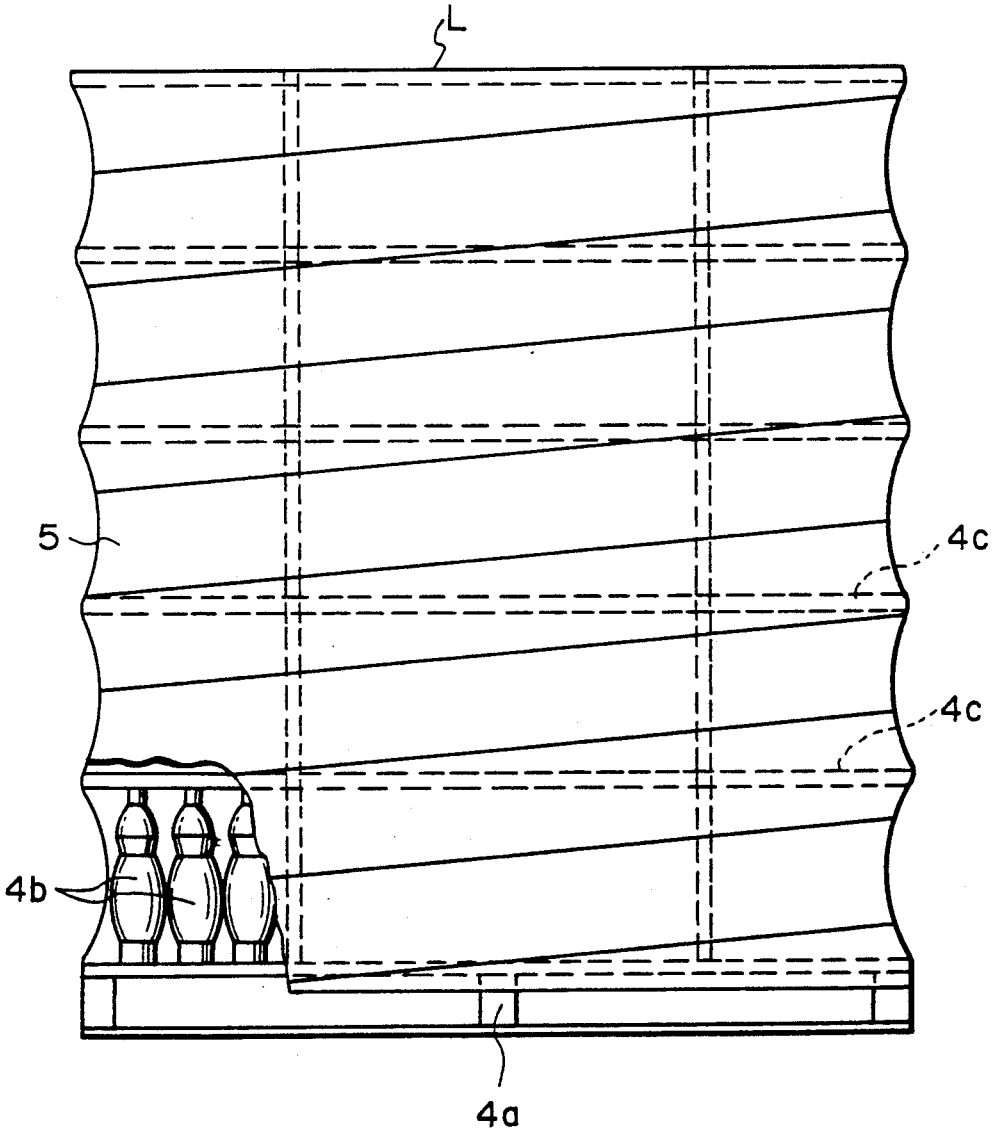
FIG. 10 is an elevational side view of an example of the palletized and stretch-wrapped load.

FIG. 1 is an overall perspective view of an unwrapping apparatus according to the present invention and FIG. 2 is its elevational side view. The unwrapping apparatus is adapted to unwrap a palletized and stretch-wrapped load L, such as that shown in FIG. 10. In FIG. 10, the load L is comprised of a pallet 4*a*, a plurality of articles 4*b* palletized on the pallet 4*a* and a stretchable film 5 wrapping the articles 4*b* and the pallet 4*a* together. In this example, the articles 4*b* are empty PET bottles which are placed on the pallet 4*a* in bulk via separate sheets 4*c*. The stretchable film 5 includes multiple layers encircling the articles 4*b* in tension, and may contact the articles 4*b* at the peripheral regions of the stretch-wrapped load L. The stretchable film 5 may enter any gaps or cavities between the separate sheets 4*c* or between the pallet 4*a* and the separate sheet 4*c* and shows a concave profile, as shown in FIG. 10. Such a palletized and stretch-wrapped load L can be transported to a user, such as a bottling plant, and unwrapped there.

Referring to FIGS. 1 and 2, the unwrapping apparatus includes a base frame 1, a first front upright frame 2*a* and a second rear upright frame 2*b*. A chain conveyor 3 is provided on the base frame 1 for conveying the stretch-wrapped load L to a position between the first and second upright frames 2*a* and 2*b*. Of course, the other conveying means such as a roller conveyor or an autoguided vehicle can be used. A platen 6 as a pressing means is provided to press a top central region of the palletized articles to stabilize the latter during unwrapping.

Figure 4:
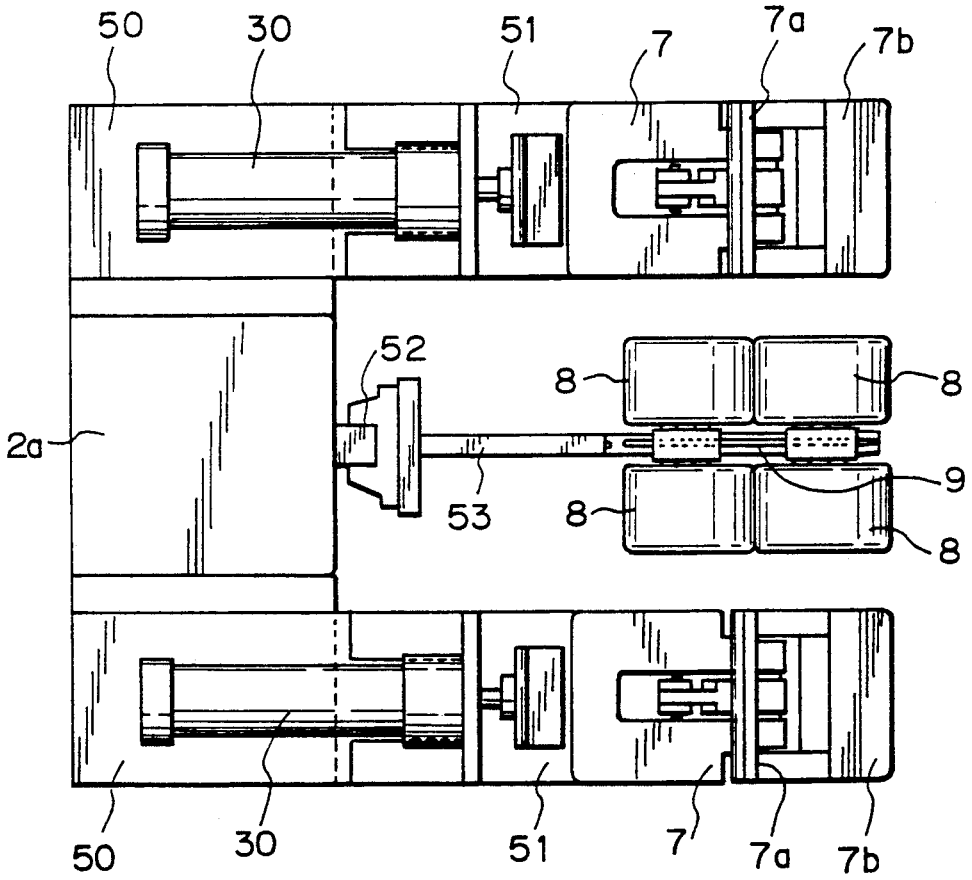
FIG. 4 is a plan view of a cutter unit and lower grippers mounted on the first front upright frame of the unwrapping apparatus of FIGS. 1 and 2.
Figure 5:
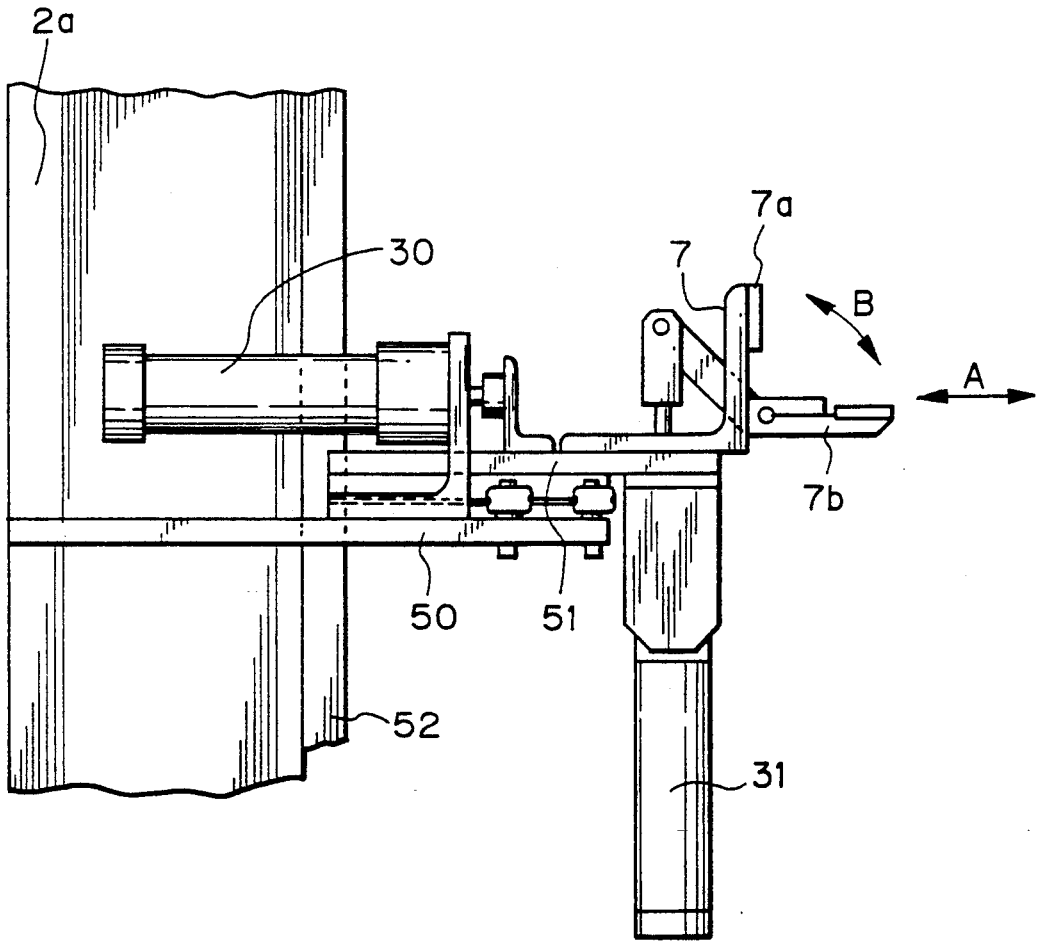
FIG. 5 is an enlarged elevational side view of the lower grippers.

As shown in FIGS. 1 and 2, and particularly in FIGS. 4 and 5, the first upright frame 2*a* has lower gripper brackets 50 attached at a lower portion of the first upright frame 2*a* on either side thereof. Slidable brackets 51 are positioned on the lower gripper brackets 50, respectively, and secure lower grippers 7 thereon, respectively, so that the lower grippers 7 with the slidable brackets 51 are movable toward and away from the load L, as shown by the arrow A. Pneumatic cylinders 30 are provided to move the slidable brackets 51, respectively. Each of the lower grippers 7 has a vertical stationary jaw 7*a* and a movable jaw 7*b*, as shown in FIG. 5. The movable jaw 7*b* is moved toward and away from the stationary jaw 7*a* for the gripping action by a pneumatic cylinder 31, as shown by the arrow B.

Figure 6:
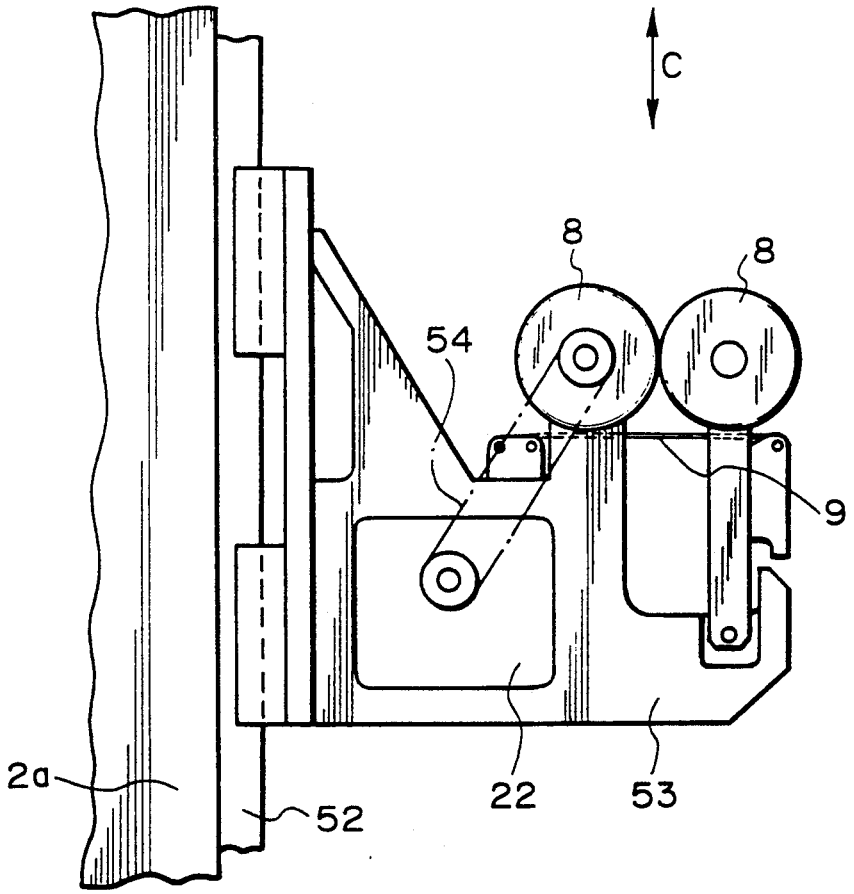
FIG. 6 is an enlarged elevational side view of the cutter unit.

The first upright frame 2*a* also has a vertical slide guide 52 at the inner side thereof facing the second upright frame 2*b*. A cutter unit slider 53 is engaged with the vertical slide guide 52 for upward and downward movement along the first upright frame 2*a*, as shown by the arrow C. An electric motor 21 moves the cutter unit slider 53 upwards and downwards along the vertical slide guide 52 via a chain or the like (not shown). The cutter unit slider 53 supports two pairs of pinch rollers 8 and an electric heat cutter 9 adapted to cut the stretchable film 5. As shown in FIGS. 4 and 6, the heat cutter 9 extends between the two lower grippers 7 toward the palletized load L, and the two pairs of pinch rollers 8 are arranged on either side of the heat cutter 9, and just above the heat cutter 9. As shown in FIG. 4, the pinch rollers 8 of each pair contact each other and the contact surface between the pinch rollers 8 of each pair extends generally on a line passing through the vertical planes of the stationary jaws 7*a* of the lower grippers 7. Since the lower grippers 7 grip the lower edge of the stretchable film 5 of the stretch-wrapped load L with the stretchable film 5 rested against the stationary jaws 7*a*, it will be understood that one of each pair of pinch rollers 8 is positionable on the exterior side of the stretchable film 5 of the stretch-wrapped load L, and the other on the interior side of the stretchable film 5 to grip the stretchable film 5 therebetween. An electric motor 22 drives (or rotates) the pinch rollers 8 via a belt 54.

Figure 3:
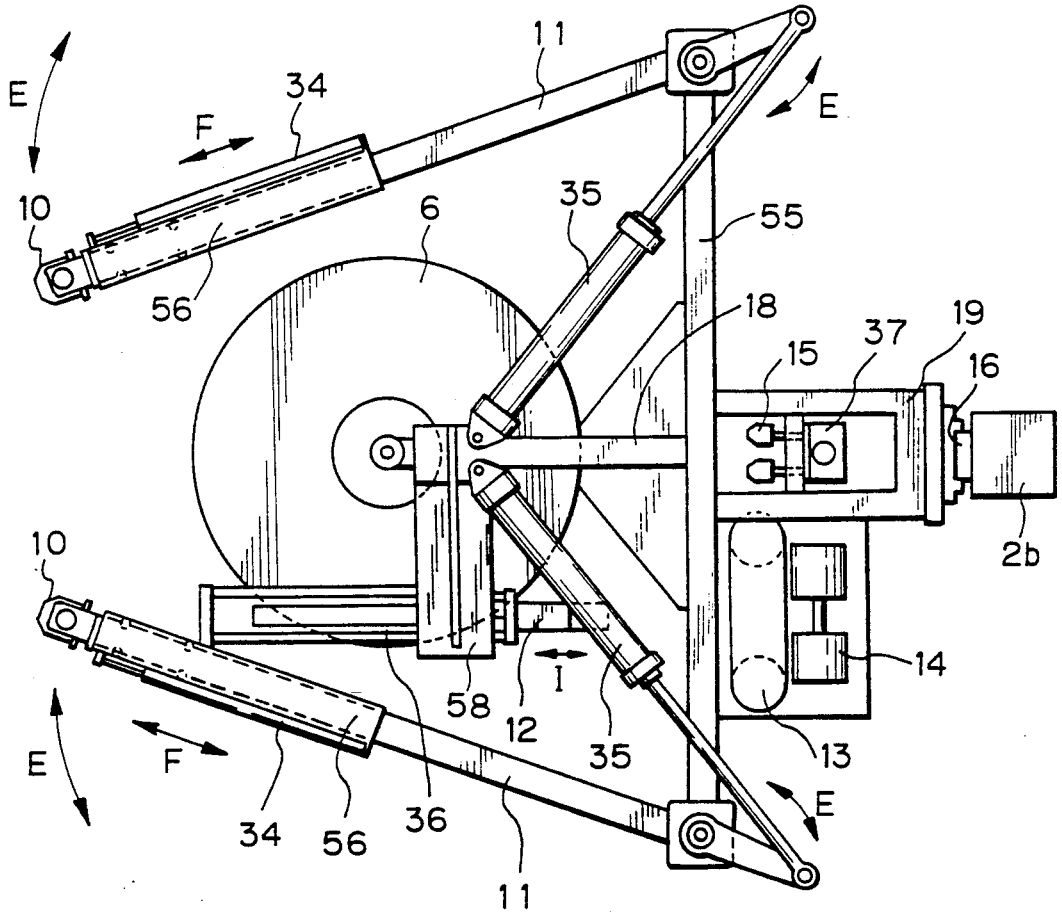
FIG. 3 is a plan view of a carriage mounted on the second rear upright frame of the unwrapping apparatus of FIGS. 1 and 2.

As shown in FIGS. 1 to 3, the second upright frame 2*b* has a vertical slide guide 16 at the inner side thereof facing the first upright frame 2*a*. A carriage 19 is engaged with the vertical slide guide 16 for upward and downward movement along the second upright frame 2*b*, as shown by the arrow D. An electric motor 20 moves the carriage 19 upwards and downwards via a chain or a belt 17. The carriage 19 has a swing arm support frame 55 fixed to the free end of the carriage 19 and a platen arm 18 extending from the central position of the swing arm support frame 55. The platen arm 18 supports the platen 6. The swing arm support frame 55 horizontally extends perpendicular to a plane including the first and the second upright frames 2*a* and 2*b* and is located at such a position that the swing arm support frame 55 is slightly behind the stretch-wrapped load L to be unwrapped, as shown in FIG. 1. The length of the swing arm support frame 55 is slightly larger than one side of the stretch-wrapped load L.

A pair of swing arms 11 are pivotally mounted respectively on either end of the swing arm support frame 55 and symmetrically arranged on either side of the platen 6. The length of each of the swing arms 11 is slightly larger than one side of the stretch-wrapped load L. The swing arms 11 extend from the swing arm support frame 55 toward the first upright frame 2*a* and have respective ends pivotally attached to the swing arm support frame 55 of the carriage 19 and the other ends provided with upper grippers 10, respectively, for gripping an upper edge of the stretchable film 5 of the stretch-wrapped load L to be unwrapped. Pneumatic cylinders 35 are associated with the swing arms 11, respectively, to cause the swing arms 11 to swing relative to the swing arm support frame 55, as shown by the arrow E.

Figure 7:
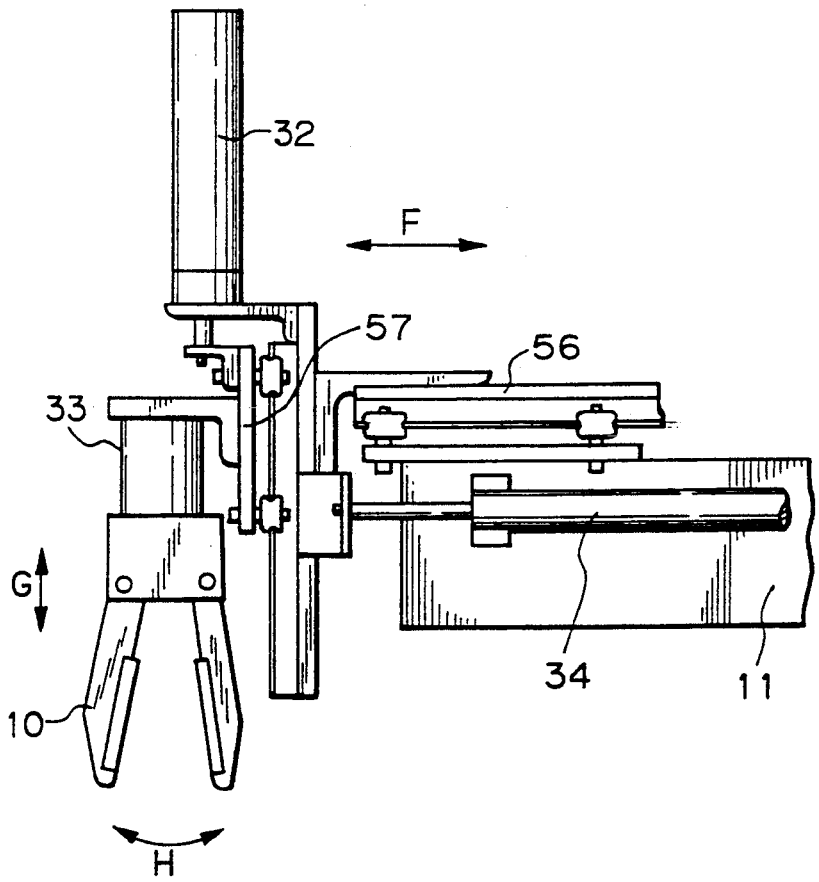
FIG. 7 is an enlarged elevational side view of the upper grippers.

As shown in FIGS. 2, 3 and 7, each of the upper grippers 10 is attached to the respective swing arm 11 via a slidable gripper plate 56 and a slidable elevator plate 57, and thus movable toward and away from the stretch-wrapped load L, as shown by the arrow F, and upward and downward, as shown by the arrow G. Pneumatic cylinders 34 are associated with the slidable gripper plates 56, and pneumatic cylinders 32 are associated with the elevator plate 57, for this purpose. The upper gripper 10 is attached to the slidable elevator plate 57 by a pneumatic cylinder 33 and a rack and pinion which opens and closes the upper gripper 10 for a gripping action, as shown by the arrow H.

Further, a pusher bracket 58 extends perpendicularly from the platen arm 18 and supports a horizontal pneumatic cylinder 36 that has a piston rod securing a pusher 12. The pusher 12 is arranged below the swing arm support frame 55 and is movable toward and away from the swing arm support frame 55, as shown by the arrow I in FIG. 3. The carriage 19 also has a ring-like collecting guide 13 arranged in alignment with the pusher 12. The collecting guide 13 has a circular or a trumpet-shaped opening into which the pusher 12 can be inserted. The pusher 12 forces the stretchable film 5 into the collecting guide 13 as soon as the stretchable film 5 is cut and separated from the palletized load L. The collecting guide 13 thus collectively guides the used stretchable film 5. In addition, a pair of discharge nip rollers 14 are arranged on the outlet side of the collecting guide 13 to continuously compress and discharge the stretchable film 5.

Further, an impulse heatsealer 15 is provided in the carriage 19. The carriage 19 supports a vertical pneumatic cylinder 37 having a piston rod which in turn carries a horizontal pneumatic cylinder 38. The heatsealer 15 is carried by the piston rod of the horizontal pneumatic cylinder 38. Therefore, the heatsealer 15 can be moved upward and downward, and toward and away from the stretch-wrapped load L. As shown in FIGS. 1 and 3, the heatsealer 15 is located at such a position that it can engages with the rear side of the stretchable load L, to heatseal and join together the plurality of layers of the stretchable film 5. If a top cover is provided on the load L, the heatsealer 15 can join the top cover and the stretchable film 5, to unitize them together to discharge them through the pusher 12, the collecting guide 13 and the discharge nip rollers 14.

Further sensors 40 to 44 are provided for detecting the positions of the stretch-wrapped load L and the other elements. The sensors 40 to 44 comprises, for example, beam switches or limit switches. The sensor 40 detects that the stretch-wrapped load L reaches a predetermined unwrapping position between the first and the second upright frames 2*a* and 2*b*. The sensor 41 detects that the platen 6 presses the stretch-wrapped load L. The sensor 42 detects that the cutter unit slider 53 is at a predetermined lower position and the sensor 43 detects that the cutter unit slider 53 is below and near the top of the stretch-wrapped load L. The sensor 44 detects that the cutter unit slider 53 moves above the top of the stretch-wrapped load L.

In operation, the palletized and stretch-wrapped load L is conveyed to the predetermined unwrapping position between the first and the second upright frames 2*a* and 2*b* by the conveyor 3 and stopped there by the output signal of the sensor 40. When the stretch-wrapped load L reaches this position, the lower grippers 7 are waiting in the position of FIG. 5, and the cutter unit slider 53 is waiting in the position of FIG. 6, just below the lower grippers 7. The carriage 19 supporting the platen 6, the upper grippers 10 and the swing arms 11 is in the position of FIGS. 2 and 3 above the load L.

When the stretch-wrapped load L is stopped at the predetermined position, the carriage 19 is moved downward together with the platen 6 to press the top of the stretch-wrapped load L, and is stopped by the output signal of the sensor 41. The upper grippers 10 are simultaneously lowered but stopped just above the upper edge of the stretch-wrapped load L.

Figure 8A:
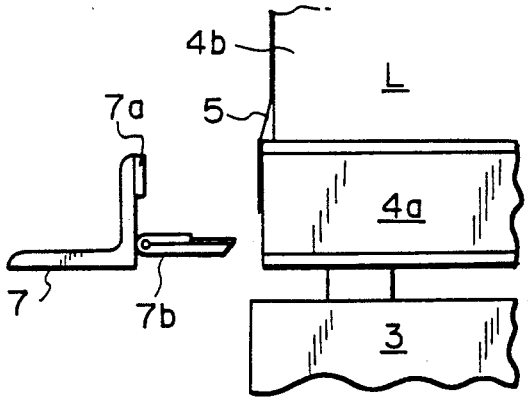
FIGS. 8A to 8D are views illustrating the operation of the lower grippers.
Figure 8B:
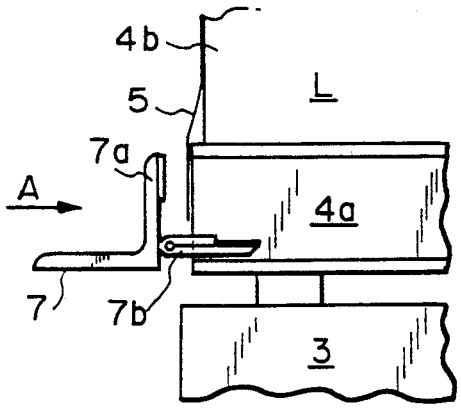
Figure 8C:
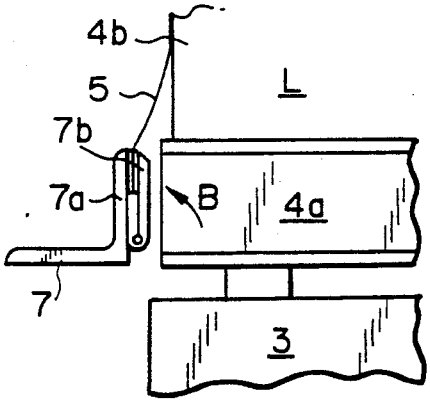
Figure 8D:
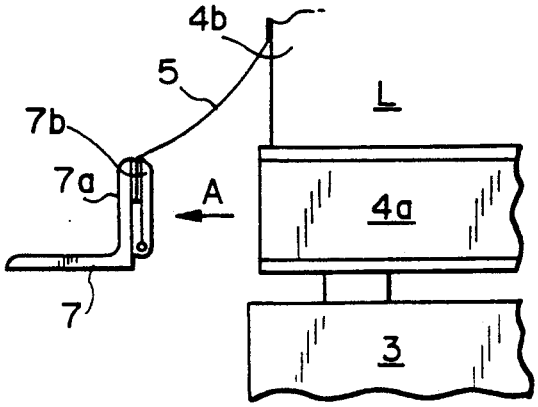

The movable jaw 7*b* of the lower grippers 7 are initially in the horizontal positions, as shown in FIGS. 5 and 8A. The lower grippers 7 are first moved toward and beyond the lower edge of the stretchable film 5, as shown in FIG. 8B. Then the movable jaw 7*b* of the lower grippers 7 is operated to grip the stretchable film 5 between the movable jaw 7*b* and the stationary jaws 7*a*, as shown in FIG. 8C. Then the lower grippers 7 are moved away from the lower portion of the palletized load L, as shown in FIG. 8D. Thus a lower portion of the stretchable film 5 is pulled out and separated from the articles 4*b* or the pallet 4*a* to make gap between the lower portion of the stretchable film 5 and the articles 4*b* or the pallet 4*a*.

Then the pinch rollers 8 start to rotate and the cutter unit slider 53 is moved upward along the first upright frame 2*a*. Thus the pinch rollers 8 pinch the stretchable film 5 from the exterior side and the interior side thereof and the heat cutter 9 starts cutting the stretchable film 5. Note, cutter unit slider 53 is set at a position spaced apart from the stretch-wrapped load L and moves along a path designed so that the pinch rollers 8 and the heat cutter 9 do not contact the articles 4*b* while the pinch rollers 8 pull the stretchable film 5, which is initially in close contact with the articles 4*b*. It is advisable to use the heat cutter 9 because it not only severs the stretchable film 5 but also welds together the multiple layers of the stretchable film 5 to avoid scattering the multiple layers of the film.

The cutter unit slider 53 is stopped by the output signal of the sensor 43 located near the top of the stretch-wrapped load L. Then the upper grippers 10 move downwards and actuated to grip the upper edge of the stretchable film 5 at positions on the outsides of the pinch rollers 8, i.e. on the left and right sides of the pinch rollers, viewed from the front. Then the cutter unit slider 53 is restarted and again stopped depending on the output signal of the sensor 44 located above the top of the stretch-wrapped load L. Thus the stretchable film 5 is completely cut and separated along the cutting line to the left and to the right thereof. In this way, the stretchable film 5 is maintained in tension while the stretchable film 5 is separated from the stretch-wrapped load L since the lower grippers 7 are gripping the lower edge of the stretchable film 5 and the upper grippers 10 are gripping the upper edge of the stretchable film 5.

Figure 9A:
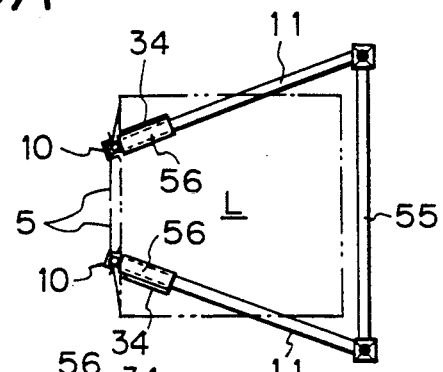
FIGS. 9A to 9E are views illustrating the operation of the upper grippers and the swing arms.
Figure 9B:
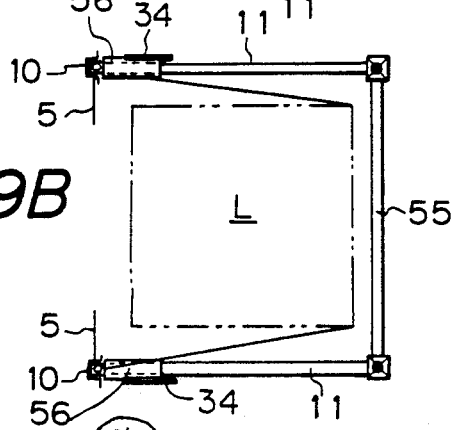
Figure 9C:
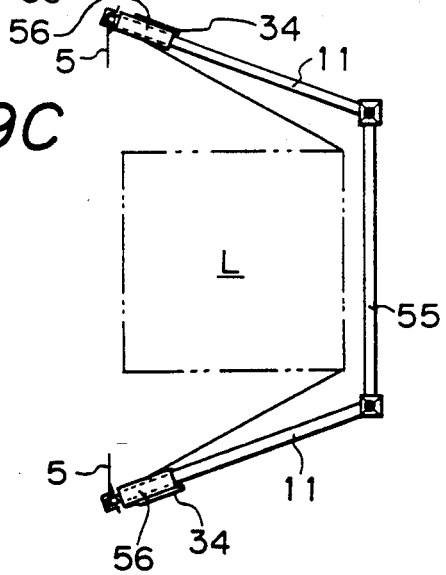
Figure 9D:
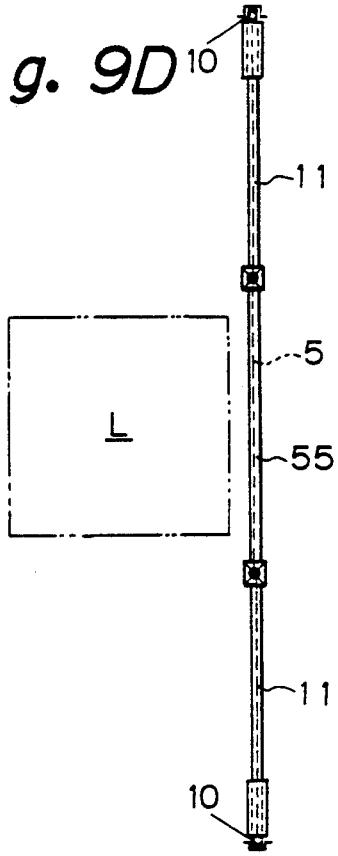
Figure 9E:
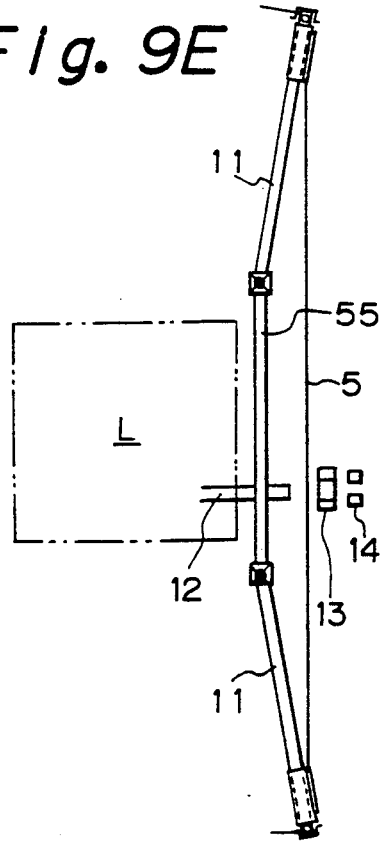

Finally, the lower grippers 7 release the lower edge of the stretchable film 5 and the upper grippers 10 move upward with the actuation of the pneumatic cylinder 32. Simultaneously, the swing arms 11 are spread from each other with the actuation of the pneumatic cylinders 35. Thus the severed vertical edges of the stretchable film 5 are laterally opened in the front side of the palletized load L (or articles 4*b*), and separated from the front side of the palletized load L, as shown in FIG. 9B. In addition, the slidable gripper plate 56 supported at the free end of the swing arms 11, and carrying the upper grippers 10, are extended with the actuation of the pneumatic cylinders 34. Therefore, the stretchable film 5 is stretched or pulled and maintained in tension so as not to allow the stretchable film 5 of any shrinkage while the stretchable film 5 is separated from the front side and the lateral sides of the load L, as shown in FIGS. 9B and 9C. The stretchable film 5 is maintained in tension without shrinkage until it is completely separated from the palletized load L, as shown in FIG. 9D. The swing arms 11 can be finally swung to a position, as shown in FIG. 9E. The platen 6 can be lifted and stopped at the initial position at an appropriate time from the start of the swing motion of the swing arms 11 to the end of the swing motion. It will be understood that the triggering of the pneumatic cylinders can be modified from those explained above.

In this way the stretchable film 5 is fully separated from the pallet-load L (or the article 4*b*) without shrinkage. If the stretchable film 5 suddenly shrinks during removal, the articles 4*b* contact with shrinking film 5 may be moved or shifted by the shrinking film and fall down out of the pallet 4*a* or the separate sheets 4*c*. According to the present invention, it is possible to minimize an occurrence of shrinkage in the stretchable film 5.

When the stretchable film 5 is fully separated from the palletized load L (or the palletized articles 4*b*), as shown in FIG. 9E, the pusher 12 is moved toward the rearward shifted stretchable film 5 to push it into the collecting guide 13 and the discharge nip rollers 14 may be driven. Then the upper grippers 10 release the stretchable film 5 that is being pulled into the collecting guide 13 and the discharge nip rollers 14. In this course, the stretchable film 5 is compressed or squeezed into a compact belt-like shape by which it can be easily disposed.

The stretch-wrapped load L thus unwrapped is discharged by the conveyor 3 at an appropriate time after the end of the swing motion of the swing arms 11.

If the stretchable film 5 is not of cling type, a stretch wrapping can be carried out so that the multiple layers of the stretchable film 5 are firmly wound around the stretch-wrapped load L into a unitized form, but upon unwrapping, the multiple layers of the film will be separated from each other when it is cut. The heat cutter 9 that is arranged in front of the stretch-wrapped load L can function not only to cut the stretchable film 5 but also to weld multiple layers of the film together along the cutting lines. At the rear side of the stretch-wrapped load L, it is possible to use the impulse heatsealer 15 with the actuation of the pneumatic cylinders 37 and 38 to weld the multiple layers of the film together. Therefore, the stretchable film 5 can be discharged from the discharge nip rollers 14 in one piece structure and can be easily disposed. If a top cover is used at the top of the stretch-wrapped load L, it is also possible to use the impulse heatsealer 15 to weld the top cover and the stretchable film 5 together. Therefore, a combination of the top cover and the stretchable film 5 can be dealt with by the pusher 12, the collective guide 13 and the discharge nip rollers.

As explained above, according to the unwrapping apparatus of the present invention, the stretchable film 5 is gripped by the lower grippers 7 or both of the lower grippers 7 and the upper grippers 10 to maintain the stretchable film 5 in tension during the start of the cutting of the stretchable film 5 and the end of the cutting to prevent the stretchable film 5 from slackening and shrinking during the cutting.

By preventing the stretchable film 5 from shrinking while the stretchable film 5 is in contact with the articles such as empty bottles, it is possible to prevent the articles from being moved or shifted by the shrinking stretchable film 5 and falling down out of the separate sheet or the pallet. Especially, articles located at the four corners of the load L on the uppermost separate sheet have been liable to fall, but according to the present invention, it is possible to prevent the articles at said locations from falling off the load L.

Also, according to the present invention, it is possible to discharge the stretchable film 5 that is removed from the load L by pushing and collecting it into the ring-like collecting guide by the pusher and compressing it in the discharge nip rollers into a belt-like compact form.

In conclusion, according to the present invention, upon unwrapping a load comprised of a pallet, a plurality of articles such as empty bottles in bulk palletized on the pallet and stacked by an separate sheet and a stretchable film wrapping the articles and the pallet together, it is possible to effectively prevent the articles from falling off the load L, in particular from the four corners of the uppermost separate sheet, and discharge the used stretchable film in a compressed and compacted form.

We claim:

1. An unwrapping apparatus for unwrapping a load comprised of a pallet, a plurality of articles palletized on the pallet and a stretchable film wrapping the articles and the pallet together, said unwrapping apparatus comprising:

first and second upright frames arranged in a spaced relationship;

means for conveying a load to be unwrapped to a position between the first and second upright frames;

two lower gripper means arranged on the first upright frame for gripping a lower edge of the stretchable film of the load to be unwrapped, each of the lower gripper means being movable toward and away from the load to be unwrapped;

a cutter unit arranged on the first upright frame between the two lower gripper means for upward and downward movement along the first upright frame, the cutter unit having two pairs of pinch rollers with one of each pair of pinch rollers positionable on the exterior side of the stretchable film and the other on the interior side of the stretchable film to grip the stretchable film therebetween, and cutting means adapted to cut the stretchable film; and a carriage arranged on the second upright frame for upward and downward movement along the second upright frame, the carriage having pressing means to press a top central region of the load to be unwrapped to stabilize the latter while being unwrapped, and a pair of swing arms symmetrically arranged on either side of the pressing means and extending toward the first upright frame, each of the swing arms having one end pivotally attached to the carriage and the other end provided with an upper gripper means for gripping an upper edge of the stretchable film of the load to be unwrapped, each of the upper gripper means being movable upward and downward, and toward and away from the load to be unwrapped, whereby the stretchable film that is cut by the cutting means is spread and separated from the load in accordance with a swing motion of the swing arms.

2. An unwrapping apparatus according to claim 1, wherein the cutting means comprises an electric heat cutter.

3. An unwrapping apparatus according to claim 1, wherein the stretchable film including multiple layers of the film encircling the articles, and the carriage further includes a heatsealer means for movement upward and downward, and toward and away from the load to be unwrapped to heatseal and join together the plurality of turns of strips of the stretchable film.

4. An unwrapping apparatus according to claim 1, wherein the carriage further includes a ring-like collecting guide for collectively guiding the stretchable film that is cut and separated from the load, a pusher pushing the stretchable film into the collecting guide, and a pair of discharge nip rollers arranged on the outlet side of the collecting guide to continuously compress and discharge the stretchable film pushed into the collecting guide.

5. An unwrapping apparatus according to claim 1, wherein said two pairs of pinch rollers are arranged on either side of the cutting means and just above the cutting means.

6. An unwrapping apparatus according to claim 1, wherein the lower gripper means are first moved toward and beyond the lower edge of the stretchable film, then operated to grip the stretchable film, and then moved away from the palletized articles or the pallet, whereby a lower portion of the stretchable film is pulled out and separated from the articles or the pallet.

7. An unwrapping apparatus according to claim 4, wherein the cutting unit moves along a path designed so that the at least one pair of pinch rollers and the cutting means do not contact the articles.

8. An unwrapping apparatus according to claim 1, wherein the upper gripper means is operated to grip the upper edge of the stretchable film when the cutting unit reaches a position near the upper edge of the stretchable film.

9. An unwrapping apparatus according to claim 1, wherein the swing arms are initially arranged so that the distance between upper gripper means is smaller than the distance between the pivot ends of the two swing arms, and then swung outwardly about the respective pivot ends with the simultaneous movement of the upper gripper means away from the load after the stretchable film is cut, to thereby maintain tension on the stretchable film while the stretchable film separates from four corners of the load.

* * * * *